United States Patent [19]

Marsen

[11] 4,349,713

[45] Sep. 14, 1982

[54] COMBINED COOKING AND SERVING MICROWAVE APPARATUS

[76] Inventor: Herman Marsen, 201 W. 86 St., New York, N.Y. 10024

[21] Appl. No.: 122,114

[22] Filed: Feb. 19, 1980

[51] Int. Cl.[3] ..... H05B 6/80

[52] U.S. Cl. ..... 219/10.55 A; 219/10.55 D; 219/10.55 R; 219/218; 219/386; 126/340; 126/19 M; 99/443 R; 312/236

[58] Field of Search ..... 219/10.55 R, 10.55 A, 219/10.55 E, 10.55 F, 10.55 B, 10.55 C, 10.55 D, 386, 433–434, 218, 457–459, 312; 312/236, 312, 290, 250; 126/19 R, 19 M, 25 AA, 273 R, 340; 99/443 R, 451, DIG. 14

[56] References Cited

U.S. PATENT DOCUMENTS

| | | | |
|---|---|---|---|
| 1,455,395 | 5/1923 | Exum | 312/236 X |
| 2,163,165 | 6/1939 | Wise | 312/312 |
| 2,888,543 | 5/1959 | Haagensen | 219/10.55 D |
| 2,956,144 | 10/1960 | Woodman | 219/10.55 R |
| 3,364,882 | 1/1968 | Merrick | 108/25 |
| 3,436,506 | 4/1969 | Smith | 219/10.55 |
| 3,440,385 | 4/1969 | Smith | 219/10.55 |
| 3,451,401 | 6/1969 | Levinson | 134/58 |
| 3,617,693 | 11/1971 | Shimosawa | 219/218 |
| 3,867,606 | 2/1975 | Peterson | 219/10.55 |
| 3,962,962 | 6/1976 | Anderson | 219/386 X |
| 4,019,009 | 4/1977 | Kosonoki | 219/10.55 |
| 4,166,413 | 9/1979 | Meszaros | 99/393 |
| 4,219,716 | 8/1980 | Kaufman, Jr. et al. | 219/10.55 R |

FOREIGN PATENT DOCUMENTS

| | | | |
|---|---|---|---|
| 1114938 | 5/1968 | United Kingdom | 219/10.55 R |

*Primary Examiner*—B. A. Reynolds
*Assistant Examiner*—Philip H. Leung
*Attorney, Agent, or Firm*—Orville N. Greene

[57] ABSTRACT

This invention relates to a tabletop-microwave oven combination wherein the microwave oven is provided with a cabinet having an opening at the top in which a horizontally sliding door is mounted. The tabletop also includes an opening in the control portion thereof adapted to receive the microwave oven and a pedestal or body surrounding the oven which is inserted in the opening. The door of the oven when moved horizontally to open the oven, slides in a slot within the tabletop or moves in a space just below the tabletop. The oven contains a tray designed to hold a utensil containing food and means are provided within the oven to lift the tray to a position astride of the oven when the door is open.

4 Claims, 5 Drawing Figures

COMBINED COOKING AND SERVING MICROWAVE APPARATUS

Figure 1:
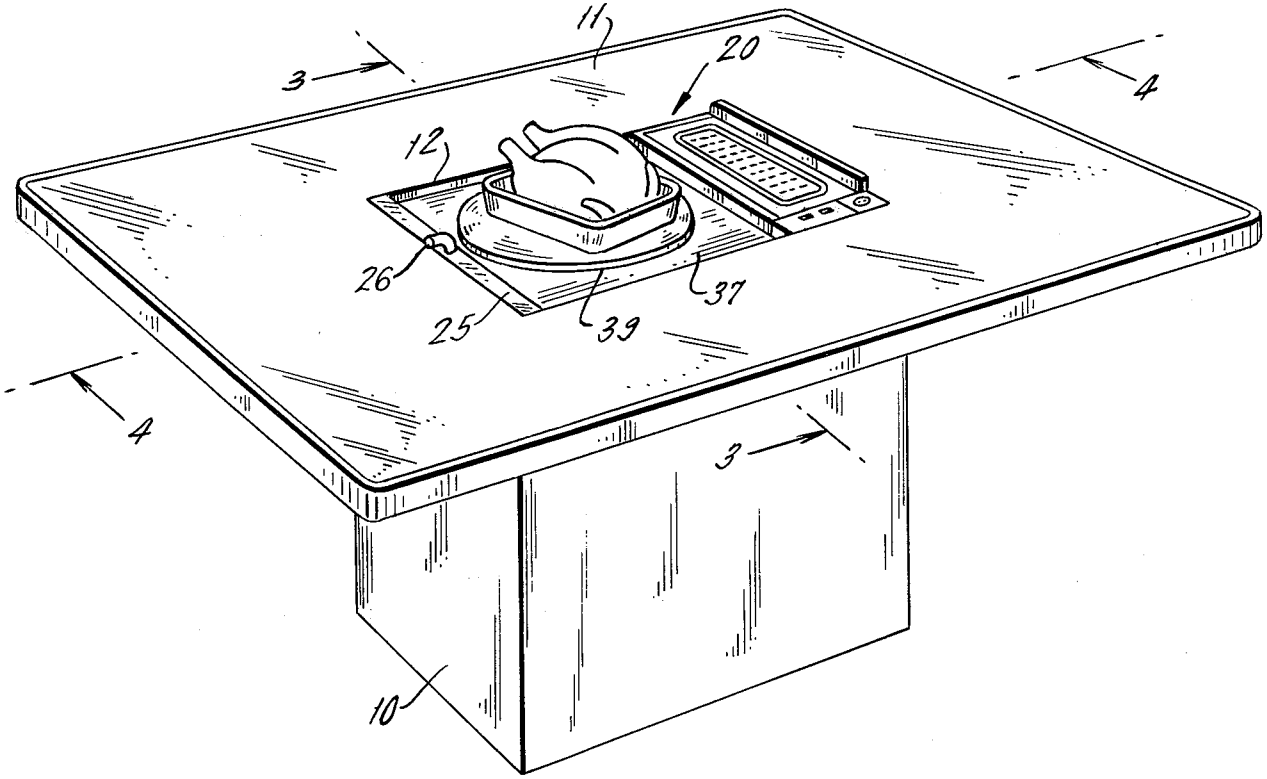

This invention relates to a microwave oven combined with a serving surface such as a table or a cart wherein the microwave oven is provided with additional shielding body in the form of the pedestal support for the table or the body of the cart.

According to the invention, the body of the microwave oven is enclosed in the pedestal of a table or similar serving area or into the body of a serving cart. The oven is provided with a door which opens at the top and means are provided to lift the food holding shelf of the oven to a position level with or outside of the top of the oven or into the serving area of the table. The door of the oven is preferably made horizontally slidable into the area below the surface of the table and may be made in one or two parts.

BACKGROUND OF THE INVENTION

Microwave ovens are generally made with front opening doors and such doors having hinges at one side are susceptible to sagging and the accumulation of food residue on the surface of the door seals leading to leakage of microwave energy. This has prompted the Food and Drug Administration to require microwave oven manufacturers to advise the consumer to take certain precautions relative to the hinged front opening oven door to avoid exposure to excessive microwave energy. This warning to the public may be one reason that usage of microwave ovens is not universally accepted. This invention eliminates the problems that make the warning necessary. Microwave ovens with doors that open at the top are shown in Levinson, U.S. Pat. Nos. 3,451,401 and in Kusunoki et al., U.S. 4,019,009 (FIGS. 17 and 18). In these ovens the doors are hinged and pivot upwardly to open. Also, U.S. 3,745,291 (Peterson et al.) and 3,867,606 (Peterson) disclose microwave ovens for treating tires in which the oven is provided with a hinged door at the top and in which the tire after treatment can be elevated. U.S. 3,440,385 of Smith discloses a microwave oven with a front opening door in which the door slides on a pair of guides to pull the treated material out of the oven as the door is opened.

SUMMARY OF THE INVENTION

Among the objectives of the present invention is to provide a combination microwave oven and serving means wherein additional protection from microwaves is provided for the user.

Among other objectives of the invention is to provide a microwave oven in combination with a serving means wherein the food to be cooked can be inserted into the oven or the cooked food can be removed from the oven without reaching into the cooking area.

These and other objectives and advantages are attained by providing a microwave oven with a top opening, sliding door or doors and with means to lift the cooking tray of the oven upwardly through the top opening and by building the oven into the pedestal of a table or the like or into the body of a serving cart. the pedestal of the table or the body of the cart provides additional shielding to increase safety precautions against microwave leakage. Since the microwave energy cooks food in a relatively short time, the table or cart is well suited for direct serving of hot cooked meals to diners.

Many microwave cooking recipes require removal of foods from the oven as many as two or three times during the cooking process for turning and stirring of food. The automatic lifting means of this invention simplifies this procedure and eliminates the handling of hot foods in and out of the oven.

Further objectives and features of the invention will be apparent from the reading of the following specification and claims and from a consideration of the accompanying drawings showing several modifications and embodiments of the invention.

Figure 2:
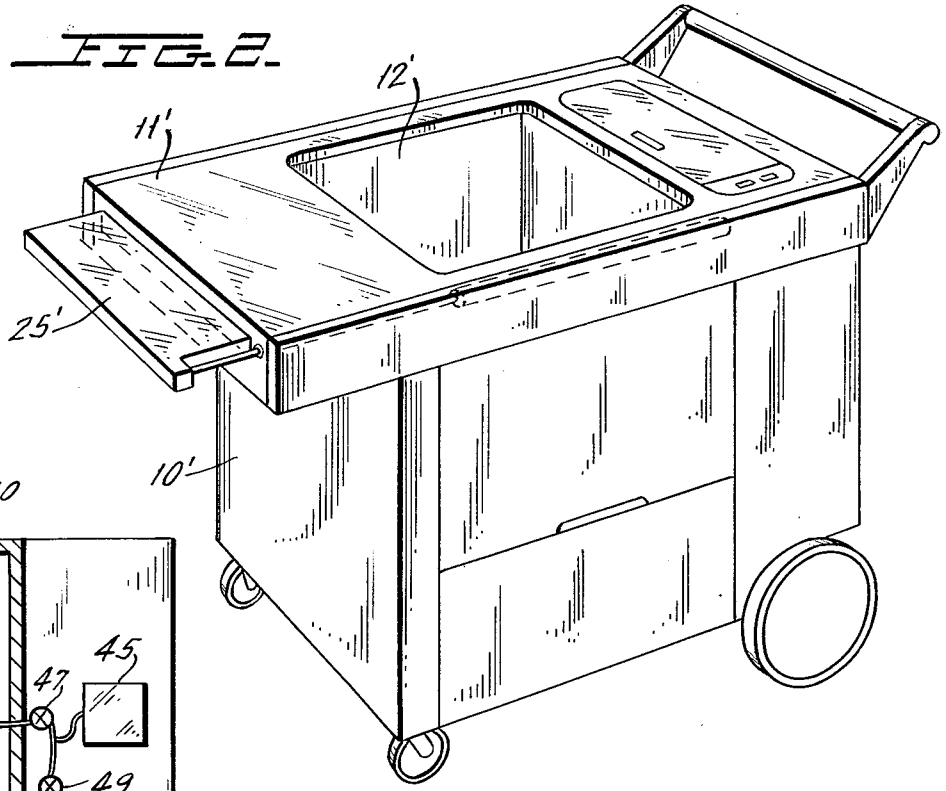
Figure 5:
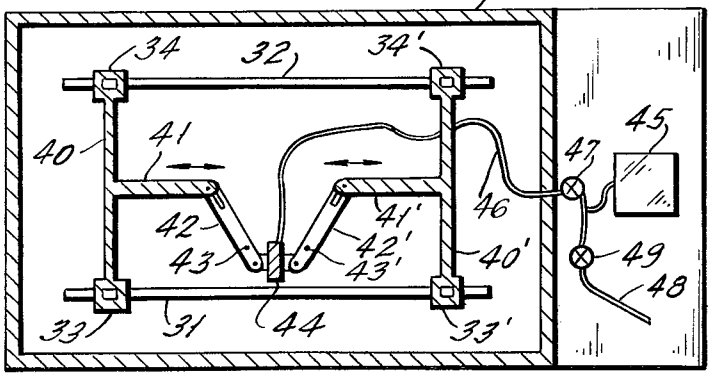
Figure 4:
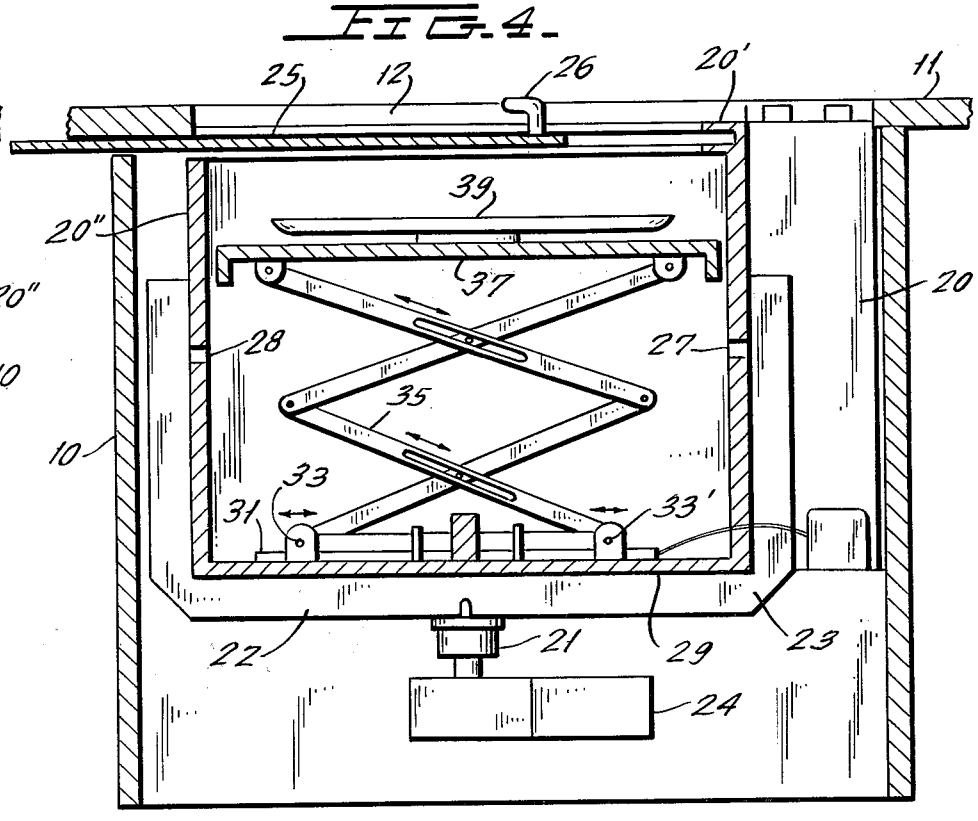
Figure 3:
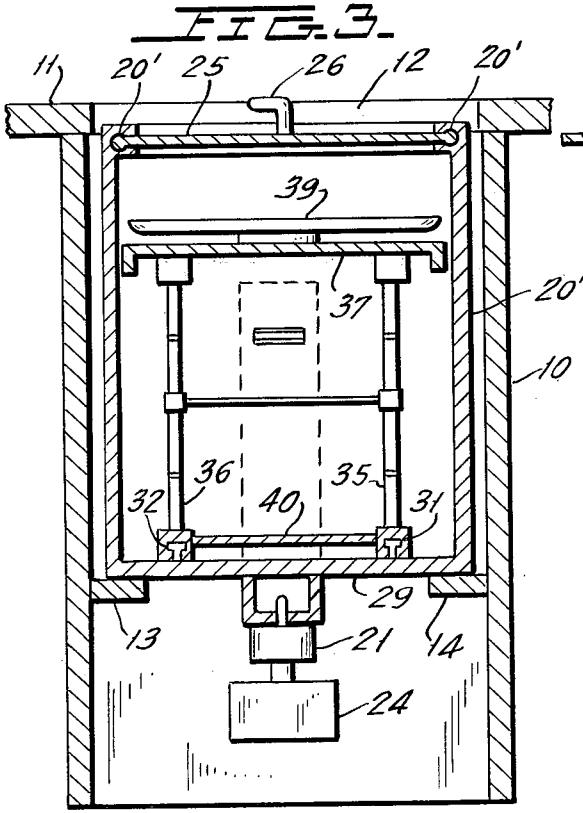

In the drawings,

FIG. 1 is a perspective view of a pedestal table containing a microwave oven made according to the invention with the cooking tray in raised position, FIG. 2 is a perspective view of a serving cart containing a microwave oven made according to the invention with the sliding door open but before the cooking tray is raised, FIG. 3 is a cross-sectional view of the table of FIG. 1 taken on line 3—3 of FIG. 1, FIG. 4 is a cross-sectional view of the table of FIG. 1 taken on line 4—4 of FIG. 1, FIG. 5 is a plan view of the lifting arrangement of FIG. 4 taken on line 5—5 of FIG. 4.

The table combination of FIG. 1 has a hollow pedestal 10, made at least partly of metal, a table top 11 and an opening 12 in the table top 11 adapted to receive the microwave oven 20. Suitable supports 13, 14 are provided in the interior of the pedestal 10 to hold the oven 20.

The microwave oven itself includes a microwave generator such as a magnetron 21, suitable wave guide transmission means 22, 23 for feeding the energy to the interior 22 of the oven and, if desired, a blower 24 for feeding air over the magnetron 21 and through the wave guides 22, 23 and openings 27, 28 to the interior of the oven. This invention is not concerned with the particular means for generating or transmitting the microwave energy and these parts are shown only diagramatically. The oven comprises the cabinet 20" which is closed by a sliding door 25 adapted to slide beneath the table top 11 or in a slot within the table top 11. Suitable latch means 26 is provided on the sliding door 25 to lock the door in closed position. Preferably, close interfitting is provided between the sides of the sliding door 25 and the slide rails 20' of the cabinet 20 such as shown in FIGS. 2 and 3.

Attached to the bottom 29 of the oven of FIGS. 3-4 is a pair of rails 31, 32 on which slide pairs 33, 34 of the lifting mechanism, are adapted to slide. Slides 33, 33' are attached to a lazy tongs type of lift 35 above track 31 and slides 34, 34' are attached to a similar lazy tongs device 36 above track 32. When operated in unison, devices 35, 36 lift the tray 37 from a position below microwave feeding slots 27, 28 to a position outside of the oven as shown in FIG. 1.

Tray 37 may be made of material which reflects microwaves. Positioned on the tray 37 is a food holding plate 39. This latter plate 39 may be made of material such as glass which is transparent to microwaves. The lazy tongs devices are operated by the mechanism shown in more detail in FIG. 5. Thus, guide 33 is connected to guide 34 by a cross bar 40 and a similar cross bar 40' connects guides 33' and 34'. The bars 40 and 40' contain central arms 41, 41' which are linked to levers 42, 42' pivotally mounted at 43, 43'. A double hydraulic piston 44 operates the free arms of levers 42, 42' to cause cross bars 40, 40' to move toward or away from one another and thereby lift or lower the tray 37. Double hydraulic piston 44 is operated by pump 45 through hydraulic line 46. Pump 45 contains a fluid reservoir which receives or discharges hydraulic fluid to the lever when valve 47, controlled from the oven panel, is open. Another branch 48 of the hydraulic line may be employed to operate one or two pistons to open the door 25' of FIG. 2. A valve 49 controls the feed of fluid in the line 48. Valves 47, 48, pump 45, etc. are programmed to operate in their proper sequence by a suitable device such as a microprocessor.

The serving cart similarly includes additional metal shielding and a tray lifting means. Other means may be employed for raising the tray 37 from the cooking position to the exposed position. For example, the screw-type raising means shown in U.S. Pat. No. 3,745,291 may be employed. This device can also provide for rotation of the plate during cooking.

Obviously, this combination can be built into other types of furniture having a tabletop or the equivalent thereof.

I claim:

1. A combined cooking and serving microwave apparatus comprising:

a tabletop having a central opening therein and hollow support means extending downwardly from the central opening, means within said hollow support for retaining a microwave oven thereon with the top portion of the microwave oven below the level of the tabletop, said microwave oven having a control panel in the top portion thereof which is accessible through the opening of said tabletop, door means on the microwave oven at the top portion thereof, said door means being operable to open and close the oven by a horizontal sliding motion, said tabletop being constructed and arranged to accommodate the sliding door, tray means within said oven for holding an article of food being cooked, means for lifting and lowering said tray means from a position deep within the oven where it is adapted to be surrounded by microwaves when the sliding door is closed to a position outside of the oven and above the tabletop when the door is in open position.

2. The combined cooking and serving microwave apparatus as claimed in claim 1 wherein said tabletop is part of a table and wherein the hollow support means provides additional metal shielding and comprises a central pedestal for the table.

3. The combined cooking and serving microwave apparatus as claimed in claim 1 wherein said tabletop is part of a serving cart and wherein said hollow support means provides additional metal shielding and comprises the body of the serving cart.

4. The combined cooking and serving microwave apparatus as claimed in claim 1 wherein the sliding door interfits with the body of the oven to prevent leakage of microwaves.

* * * * *